United States Patent [19]

Kuhlow et al.

[11] Patent Number: 4,461,218

[45] Date of Patent: Jul. 24, 1984

[54] ELECTRIC RAIL PROPULSION UNIT

[75] Inventors: Jürgen Kuhlow; Christian Sohrt, both of Berlin, Fed. Rep. of Germany

[73] Assignee: Siemens Aktiengesellschaft, Munich, Fed. Rep. of Germany

[21] Appl. No.: 290,314

[22] Filed: Aug. 5, 1981

[30] Foreign Application Priority Data

Aug. 11, 1980 [DE] Fed. Rep. of Germany ..... 3030594

[51] Int. Cl.[3] ..... B61C 3/00; B61C 17/00

[52] U.S. Cl. ..... 105/137; 105/133; 105/140; 280/786

[58] Field of Search ..... 105/135, 136, 137, 140, 105/133, 220, 221; 180/298, 294, 54 F; 280/786; 310/52, 58

[56] References Cited

U.S. PATENT DOCUMENTS

| | | | |
|---|---|---|---|
| 576,492 | 2/1897 | Westinghouse | 105/221 R |
| 1,446,479 | 2/1923 | Nilson et al. | 180/298 |
| 1,560,351 | 11/1925 | Seidel | 280/786 |
| 2,422,824 | 6/1947 | Clauson et al. | 310/52 |
| 3,272,136 | 9/1966 | Franzén | 310/52 |
| 3,731,121 | 5/1973 | Cook et al. | 310/58 |
| 4,148,262 | 4/1979 | Eichinger | 105/133 |
| 4,167,278 | 9/1979 | Holmes | 280/786 |

FOREIGN PATENT DOCUMENTS

| | | | |
|---|---|---|---|
| 961547 | 4/1957 | Fed. Rep. of Germany | 105/136 |
| 2364594 | 6/1975 | Fed. Rep. of Germany | 105/135 |

*Primary Examiner*—Randolph Reese
*Assistant Examiner*—Glenn Foster
*Attorney, Agent, or Firm*—Kenyon & Kenyon

[57] ABSTRACT

In a propulsion unit for the driven axles of an electrically-powered rail vehicle, the torque of an electric propulsion motor is transmitted to the respective driven axle by way of a torque transmitting mechanism including gears and couplings. A common housing in the form of a hollow beam is used to enclose the propulsion motor, a bearing system, and a transmission. Cut-outs are provided in the sides of the housing to allow space for the driven axles. In order to increase the flexural and torsional stiffness of the propulsion unit, the hollow beam includes an annular end surface through which the propulsion motor and torque transmitting apparatus are inserted. The hollow beam not only forms a common housing or the propulsion components, but is a very stiff support element that reduces vibration and improves the running behavior of the propulsion unit.

10 Claims, 5 Drawing Figures

ELECTRIC RAIL PROPULSION UNIT

BACKGROUND OF THE INVENTION

1. Field of the Invention

This invention relates to propulsion units for electrically powered rail vehicles. In particular, it relates to a hollow beam that encloses the propulsion motor and the torque-transmitting means for connecting the motor to a driven axle, the beam having an opening large enough to insert the motor and the torque-transmitting means into the beam at one end to allow the beam to serve as a common housing and, simultaneously, to provide improved torsional and flexural strength to the propulsion unit.

2. The Prior Art

Propulsion units as shown in DE-OS No. 23 25 789 and DE-OS No. 23 64 594 include housings for the stator of the propulsion motor and for coupling means by which torque is transmitted from the motor to the driven axle or axles. The mechanical designs of the housings, which are connected to each other, are shaped to correspond to the propulsion components contained in the respective housings as far as the outside dimensions are concerned. The necessary boundary conditions, such as the support structure for pinion shafts in the torque-transmitting apparatus and the arrangement of the undercarriage cross beam, result in constrictions due to the limited space available and thus have a detrimental effect on the stability of the propulsion units.

British Patent Specification No. 1 438 620 describes propulsion units for electrically actuated rail vehicles, having separate housings for the motor and torque-transmitting means.

OBJECTS AND SUMMARY OF THE INVENTION

It is one of the objects of the present invention to provide an electrically actuated rail vehicle propulsion unit with increased flexural and torsional stiffness.

Further objects will be apparent from the following specification together with the drawings.

According to the present invention, a propulsion unit for an electrically powered rail vehicle includes a hollow beam, at least one end of which is defined by an annular surface that has an inner cross-sectional area and shape suitable for inserting the propulsion components, the beam being used as a common housing for all of such components. An important advantage of such a beam, the length of which corresponds to the length of the propulsion unit, is that it inherently has a high moment of resistance to deflection and, accordingly, high flexural and torsional stiffness. Such a hollow beam serving as a common housing for propulsion components can be produced so as to be lighter than existing separate housings even though the propulsion components in the common housing of the present invention are larger than corresponding components in prior, separately housed, structures. Such weight savings are obtained without degradation of the torque-producing and torque-transmitting system and are due to the substantial increase in flexural stiffness of such a structure. In addition, the propulsion unit of the present invention produces less vibration than prior propulsion units and improved running behavior is obtained in comparison to prior propulsion units constructed with the propulsion components house individually.

Assembly of the propulsion components in the common housing according to the present invention presents no difficulties provided the hollow beam has an entrance of suitable size and shape into which the propulsion components can be inserted. The opening forms a parting surface between the end of the hollow beam and closure means attached to cover the open end. The parting surfaces can be arranged so as to divide the hollow beam horizontally or vertically or to cut through arcuate cut-outs that encircle the driven axle or axles of the propulsion unit.

The hollow beam preferably has the same external dimensions over its entire length and thus is a cylindrical structure. Any material with sufficient strength, such as an aluminum alloy, can be used to make the hollow beam. However, the use of ferromagnetic material has a particular advantage in that the hollow beam can then constitute all or part of the stator structure of the propulsion motor. The closed ferromagnetic path of such a hollow beam provides the desired magnetic return path for the stator.

It is also desirable to provide the wall of the hollow beam with ribs to assist in radiating heat generated by the propulsion components. Such ribs preferably extend longitudinally along the hollow beam so that they also help to strengthen it. Alternatively, or in addition, channels may be formed in the wall of the hollow beam to carry cooling fluid to help remove heat generated by the propulsion components.

It is further preferable to integrate the hollow beam into the undercarriage of a rail vehicle by arranging the beam as the longitudinal center beam of the undercarriage and to provide it with lateral arms that engage outer parts of the axles of the propulsion unit. The high flexural and torsional stiffness of the hollow beam make this possible and provide a substantial simplification of the undercarriage design as compared with existing designs. Such existing designs include an undercarriage frame which is separate from housings for components and which is eliminated as a separate item in the present invention, since its function is taken over by the hollow beam.

DETAILED DESCRIPTION OF THE INVENTION

Figure 1:
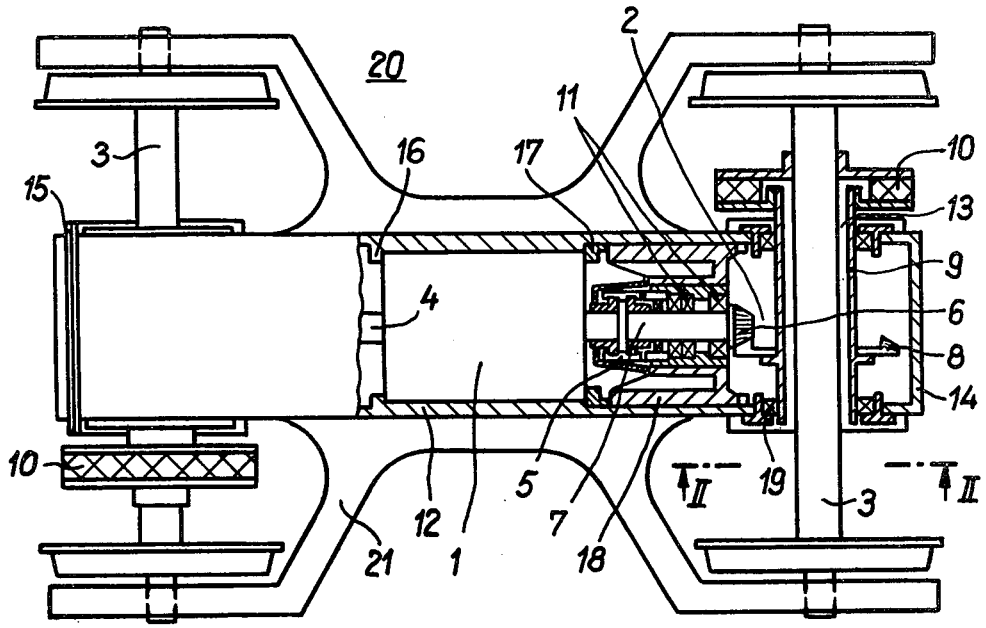
FIG. 1 is a top view of a propulsion unit constructed according to the present invention and with some parts broken away to show the internal structural features thereof.
Figure 2:
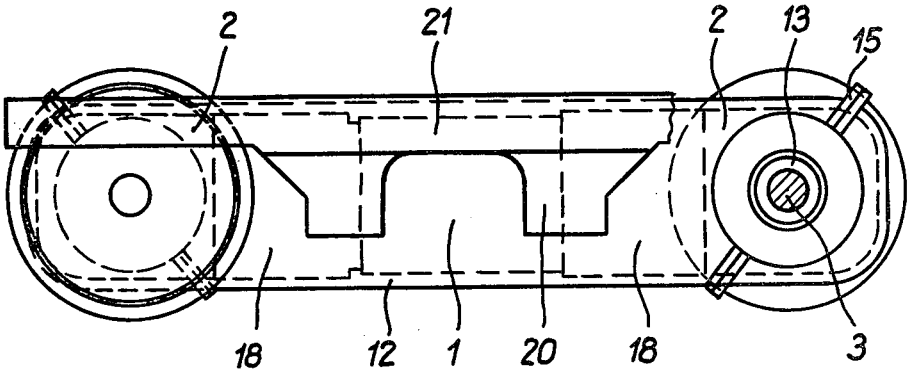
FIG. 2 is a side elevational view of the propulsion unit in FIG. 1, with part of the structure broken away to show internal features thereof.

In the electrically-powered railway propulsion unit in FIGS. 1 and 2, an electric propulsion motor 1 is connected by torque-transmitting apparatus that includes, in this embodiment, two angle-drive units 2, only one of which is shown, to transmit torque from the motor 1 to driven axles 3 at each end of the propulsion unit. The propulsion motor 1 has a rotor shaft 4, the axis of which is perpendicular to the axes of the driven axles 3. A centering coupling 5 supports a pinion 6 by holding the pinion shaft connected to the rotor shaft 4. The angle drive 2 includes a large gear 8 that meshes with the pinion 6 and is arranged on a hollow shaft 9 that surrounds the driven axle 3 and is concentric therewith and spaced therefrom. The hollow shaft 9 is connected to the driven axle 3 by way of an elastic and centering rubber coupling 10. In order to provide high flexural and torsional stiffness for the propulsion unit, all parts of the drive mechanism, such as the electric propulsion motor 1, the pinion shaft 7 and its support system formed by anti-friction bearings 11, and the angle drive 2 are arranged inside a hollow beam 12. The hollow beam 12 is preferably of cylindrical nature so that it has the same external dimensions over its entire length. It also has cut-outs 13 through which the driven axles 3 pass, together with the hollow shafts 9 surrounding each axle. A closure member 14 is provided at each end of the propulsion unit. In order to facilitate installation of the propulsion components, the hollow beam 12 has installation parting planes 15 disposed at an angle such that the parting planes intersect the cut-outs 13 for the driving axles 3 and are co-planar with the axes of the driving axles.

In order to assemble the propulsion unit, the electric propulsion motor which is designed to be complete with a housing, end bells, and a bearing system for the rotor shaft 4, is pushed into the interior of the hollow beam 12 so that one end of the motor 1 engages a stop 16 in the interior of the hollow beam 12. A spacer ring 17 is then inserted into the hollow beam to engage the other end of the propulsion motor 1, and then a support housing for the anti-friction bearings 11 of the pinion shaft 7 is inserted into the hollow beam. The hollow shaft 9 is supported by anti-friction bearings 19 that engage arcuate cut-outs at the ends of the hollow beam. The bearings 19 and the arcuate surfaces of the hollow beam 12 provide means to locate the driven axles 3 in specific positions while still allowing unhindered rotation thereof. Appropriate seals are provided through which circulation of the lubricants required for the different bearing surfaces are confined within the hollow beam 12.

By means of such an arrangement of all of the propulsion components in the anterior of the hollow beam 12, a very stiff structure is created which has improved operating characteristics in comparison with propulsion units existing heretofore. Furthermore, the hollow beam 12 also serves as a longitudinal center beam for the undercarriage 20 and is therefore provided with lateral arms 21 that engage bearings on the axles 3 to form support arms associated with the wheel sets of the undercarriage. The very stiff hollow beam 12, which extends over the entire length of the propulsion unit, results in a saving of both space and weight for the propulsion unit, as well as for the undercarriage 20.

Figure 3:
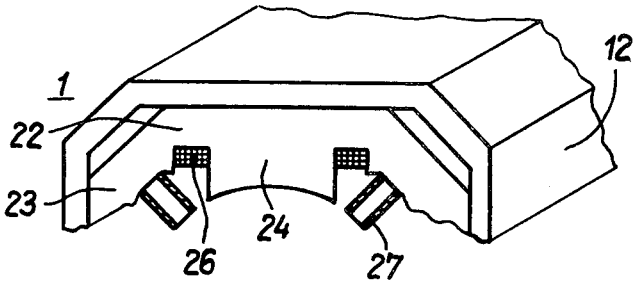
FIG. 3 is a perspective view of a fragment of the propulsion motor and hollow beam of the propulsion unit in FIG. 1.

If the hollow beam 12 consists of ferromagnetic material in the region of the electric propulsion motor 1, it can not only provide the mechanical support functions just described, but can also form, either entirely or partially, a magnetic stator circuit 22 as shown in FIG. 3. This Figure shows an embodiment in which the hollow beam 12 is utilized to conduct part of the magnetic flux of the stator circuit 22 so that, although the stator circuit has a closed stator yoke 23 that supports the main poles 24 and the commutation poles 25, the height of the hollow beam 12 is reduced as compared to the height that would be required if separate housings were used for the various propulsion components instead of the common housing provided by the hollow beam 12.

Figure 4:
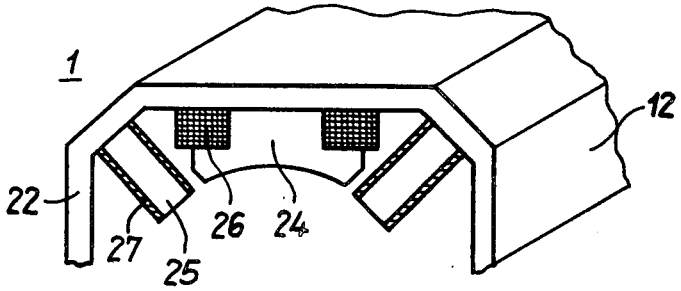
FIG. 4 is a perspective view of a modified propulsion motor stator enclosed in a hollow beam according to the present invention.

FIG. 4 shows an embodiment in which the stator structure includes laminated main poles 24 and commutation poles 25 having field windings 26 and 27, respectively, are inserted directly into the ferromagnetic hollow beam 12 so that the latter, alone, forms the magnetic return path of the magnetic stator circuit 22.

Figure 5:
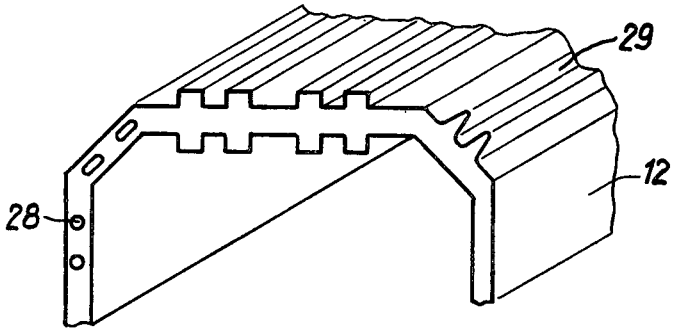
FIG. 5 is a perspective view of a fragment of a hollow beam including heat removal means according to the present invention.

The shape of the hollow beam 12 can also be chosen so that it can facilitate removal of heat losses produced by the propulsion components. Such removal of heat can be accomplished by gaseous or liquid media, and for this purpose, it is advisable, as shown in FIG. 5, either to provide the hollow beam with cooling ducts 28 through which a cooling medium can be circulated or with external ribs 29 that extend longitudinally along the propulsion unit to enlarge the cooling surface thereof.

What is claimed is:

1. In an electric rail propulsion unit comprising a driven axle, an electric propulsion motor having a stator and a rotor having an axis perpendicular to the axle, torque-transmitting means coupling the rotor to the axle to supply driving power to the axle, in which housing means containing the stator of the motor, the torque-transmitting means and bearings for the driving axle are provided and connected to each other, cutouts for the axles being provided in the housing means, the improvement comprising: the housing means comprising a single one-piece hollow beam having an internal cross-sectional area at least as great as the external cross-sectional area of the motor and of the torque-transmitting means, the motor and the the torque-transmitting means being mounted within the hollow beam, whereby the beam serves as a common housing therefor, said beam housing having a surface at its end which permits inserting the motor and torque-transmitting means longitudinally into said hollow beam.

2. The electric rail propulsion unit according to claim 1 in which the hollow beam has substantially the same external cross section over its entire length.

3. The electric rail propulsion unit according to claim 1 wherein the ends of said hollow beam are closed by closure.

4. The electric rail propulsion unit according to claim 1 in which the hollow beam comprises ferromagnetic material and forms at least part of the stator circuit.

5. The electric rail propulsion unit according to claim 1 in which the hollow beam includes a plurality of longitudinal cooling ribs extending along its external surface.

6. The electric rail propulsion unit according to claim 1 in which the hollow beam including cooling cutouts extending through its wall.

7. The electric rail propulsion unit according to claim 1 in which the hollow beam comprises a longitudinal center beam for a railway vehicle undercarriage, and further including lateral arms extending from the beam and supporting the driven axle.

8. The electric rail propulsion unit according to claim 1 comprising a second axle, the first-named axle being adjacent one end of the hollow beam and the second axle being adjacent the opposite end of the hollow beam, means supporting the first-named and second axles for rotation with respect to the hollow beam.

9. The electric rail propulsion unit according to claim 8 wherein said means supporting said axles comprise first and second hollow shafts, and bearings supporting said hollow shafts for rotation at parting planes of the hollow beam.

10. The electric rail propulsion unit according to claim 9 wherein each end of the hollow beam has a beveled surface lying in a plane substantially passing through the axis of the respective first-named and second axles and closure means comprising first and second end pieces having a matching beveled surface.

* * * * *